United States Patent [19]

Small

[11] Patent Number: 4,689,026

[45] Date of Patent: Aug. 25, 1987

[54] PROPELLER TUNNEL BAFFLE AND METHOD

[76] Inventor: Mark S. Small, 9287 SW. 16th St., Boca Raton, Fla. 33428

[21] Appl. No.: 769,438

[22] Filed: Aug. 26, 1985

[51] Int. Cl.[4] ..... B63H 5/16

[52] U.S. Cl. ..... 440/66; 440/69; 440/89

[58] Field of Search ..... 440/66-70, 440/89; 114/288, 289

[56] References Cited

U.S. PATENT DOCUMENTS

| | | | |
|---|---|---|---|
| 1,401,963 | 1/1922 | Criqui | 440/69 |
| 3,604,385 | 9/1971 | Reider | 114/289 |
| 3,793,980 | 2/1974 | Sherman | 440/69 |
| 4,300,889 | 11/1981 | Wormser | 440/69 |
| 4,371,350 | 2/1983 | Kruppa et al. | 440/69 |

*Primary Examiner*—Joseph F. Peters, Jr.
*Assistant Examiner*—Edwin L. Swinehart
*Attorney, Agent, or Firm*—Jack E. Dominik

[57] ABSTRACT

A marine craft having a propeller tunnel in which the sidewalls of the tunnel are essentially parallel and vertical and mate with a descending upper surface of the tunnel which optionally can be divided into a transom plate portion, engine plate portion, and bottom plate portion. The bottom plate portion mates with the bottom of the boat hull in a sharp line intersection. A surfacing propeller and associated drive shaft is mounted in the tunnel with a rudder positioned aft of the surfacing propeller. Baffles are provided on the lateral sides of the tunnel and terminate in a forward portion aft of the bottom plate portion of the tunnel. Optionally the exhaust can be vented onto the bottom plate portion of the tunnel to augment the flow of air. The method of the invention is directed to forcing the flow of air inside a surfacing propeller tunnel on a boat to the end that baffles provided on the lateral side are fed by air from the transom portion of the baffle and induced by the forward motion of the boat as well as the pneumatic effect of the surfacing propeller portion which is not in the water to force the air to go into the tunnel portion and thereby minimize any negative pressure build-up which would otherwise occur absent of venting. In addition the method contemplates augmenting the pressure within the tunnel by directing the exhaust to a forward portion of the tunnel.

27 Claims, 7 Drawing Figures

PROPELLER TUNNEL BAFFLE AND METHOD

FIELD OF THE INVENTION

The present invention relates to powered marine craft, and more particularly the high speed varieties. Specifically it is directed to high speed water craft which use a surfacing propeller mounted in a propeller tunnel.

SUMMARY OF THE PRIOR ART

The use of propeller tunnels is not new. This is true in both water craft and even the shrouding of aircraft. The propeller tunnel permits recessing the propeller at least in part interiorly of the projected area of the hull. Numerous problems arise with current surfacing propeller applications including dangerous exposure of the propeller. Another problem relates to the steering torque and avoiding the same. Most importantly, however, at low speeds there is cavitation and low thrust and water pile up at the transom in reverse. Accordingly achieving a planing configuration consumes considerable excess power, results in inefficient fuel consumption, and delays the boat when used as a pursuit ship or racing ship in getting up into a planing configuration and reaching the maximum intended speed. Examples of the prior art patent may be seen in the following: U.S. Pat. Nos. 2,434 700; 3,702,485; Re. 23,105; Re. 38,522; 130,391; 807,769; 815,270; 1,081,876; 1,117,357; 1,262,942; 1,401,963; 2,138,831; 3,450,090; 4,031,846; 4,363,630; 4,383,828; 22,080; Japanese Pat. No. 55-156795(A); British Pat. No. 769,307; British Application Nos. 2,075,452 and 2,055,080. In particular the U.S. Pat. Nos. 2,434,700 and 3,702,485 relate to the type of tunnel involved.

SUMMARY OF THE INVENTION

The present invention is directed to a marine craft having a propeller tunnel in which the sidewalls of the tunnel are essentially parallel and vertical and mate with a descending upper surface of the tunnel which optionally can be divided into a transom plate portion, engine plate portion, and bottom plate portion. The bottom plate portion mates with the bottom of the boat hull in a sharp line intersection. A surfacing propeller and associated drive shaft is mounted in the tunnel with a rudder positioned aft of the surfacing propeller. Baffles are provided on the lateral sides of the tunnel and terminate in a forward portion aft of the bottom plate portion of the tunnel. Optionally the exhaust can be vented onto the bottom plate portion of the tunnel to augment the flow of air, quiet engine and draw exhaust from engine. The method of the invention is directed to forcing the flow of air inside a surfacing propeller tunnel on a boat to the end that baffles provided on the lateral side are fed by air from the transom portion of the baffles and induced by the forward motion of the boat as well as the pneumatic effect of the surfacing propeller portion which is not in the water to force the air to go into the tunnel portion and thereby minimize any negative pressure build-up which would otherwise occur absent of venting. In addition the method optionally contemplates augmenting the pressure within the tunnel by directing the exhaust to a forward portion of the tunnel.

In view of the foregoing it is a principal object of the present invention to provide a vented boat tunnel in which the tunnel utilizes a surfacing propeller and venting the same to supply ambient air circulating to the forward portion of the tunnel and then rearwardly over the non-submerged portion of the surfacing propeller.

Another object of the present invention looks to the development of a tunnel for a surfacing propeller in which the major portion of the surfacing propeller is within or adjacent the tunnel, and in which baffles provide for venting the tunnel to permit accelerating the boat and maintaining planing speeds.

Yet another object of the present invention looks to the provision of a surfacing propeller tunnel which permits reducing the angle with horizontal that the drive shaft for the surfacing propeller makes thereby reducing the component which would tend to drop the bow portion of the boat into the water when underway.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF THE PREFERRED EMBODIMENTS Apparatus

Figure 1:
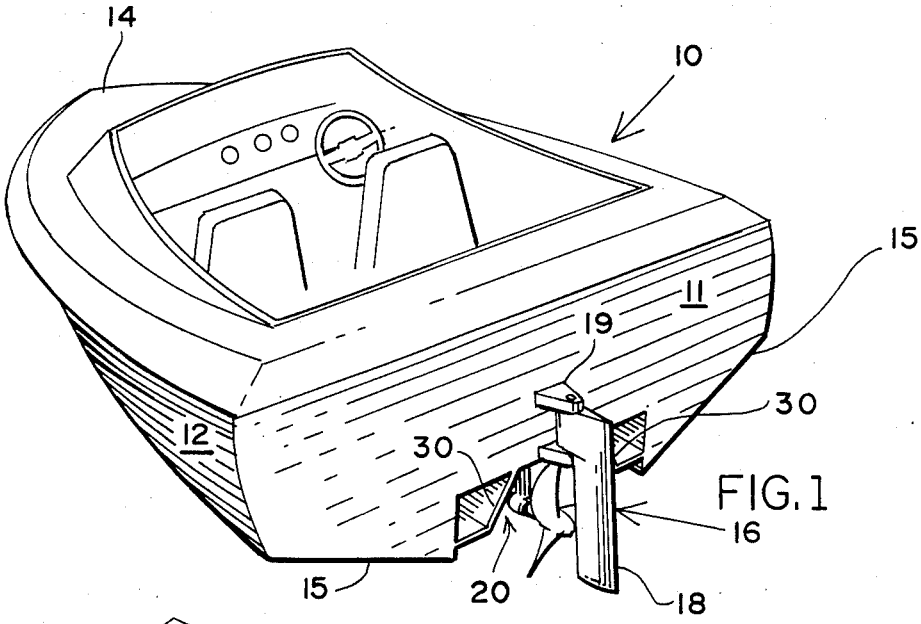
FIG. 1 is a perspective view of the rear portion of a boat having a surfacing propeller and tunnel mount for the propeller.
Figure 2:
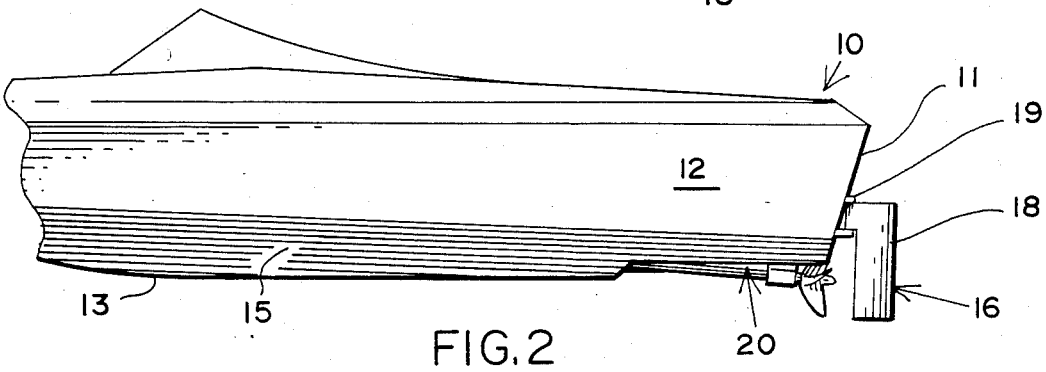
FIG. 2 is a side view of the same boat as shown in FIG. 1 in essentially the same scale.

In FIG. 1 it will be noted that a boat 10 is shown having a relatively conventional transom 11, and curvilinear sides 12 above keel 13 moving forward to a bow 14. The underneath portion of the boat is a V-bottom 15 with a keel 13 and rudder assembly 16 exterior and aft of the transom 11. The rudder assembly 16 includes the cantileverly supported rudder 18 which depends from a rudder mount 19 which, in turn, is mounted to the transom 11. The rudder can be of any convention means.

Figure 7:
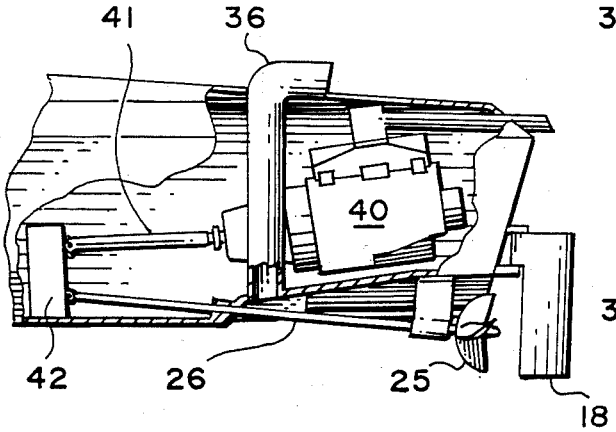
FIG. 7 showing venting from upright tubes taking air from hull interior or deck.
Figure 3:
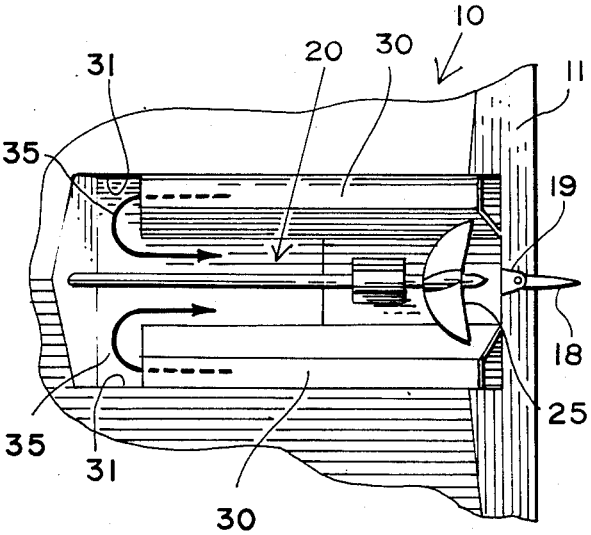
FIG. 3 is a bottom view in enlarged scale of the boat shown in FIGS. 1 and 2 focusing on the construction of the tunnel and showing the flow of air in alternative forms, the form when cruising, and the form when idling.
Figure 5:
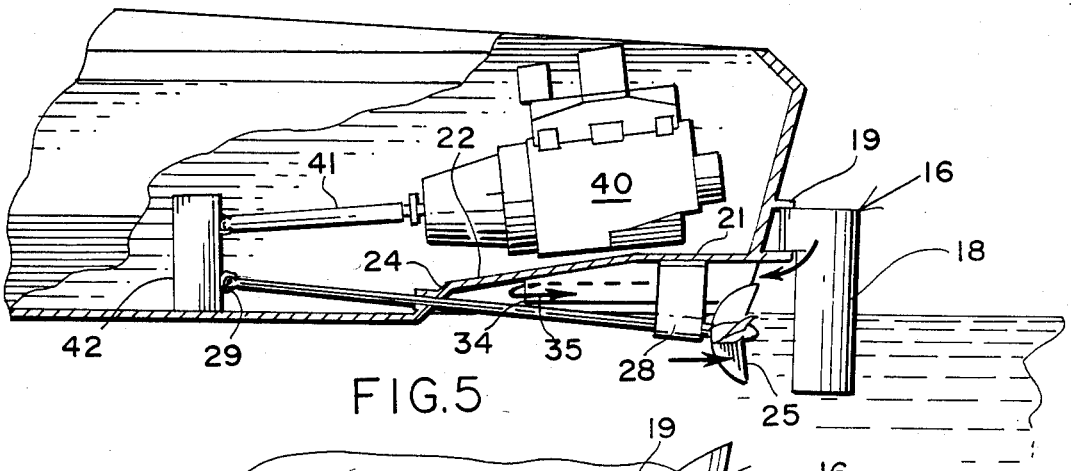
FIG. 5 is a view from the same perspective as FIG. 4 but showing the boat in its planing or crusing configuration.
Figure 6:
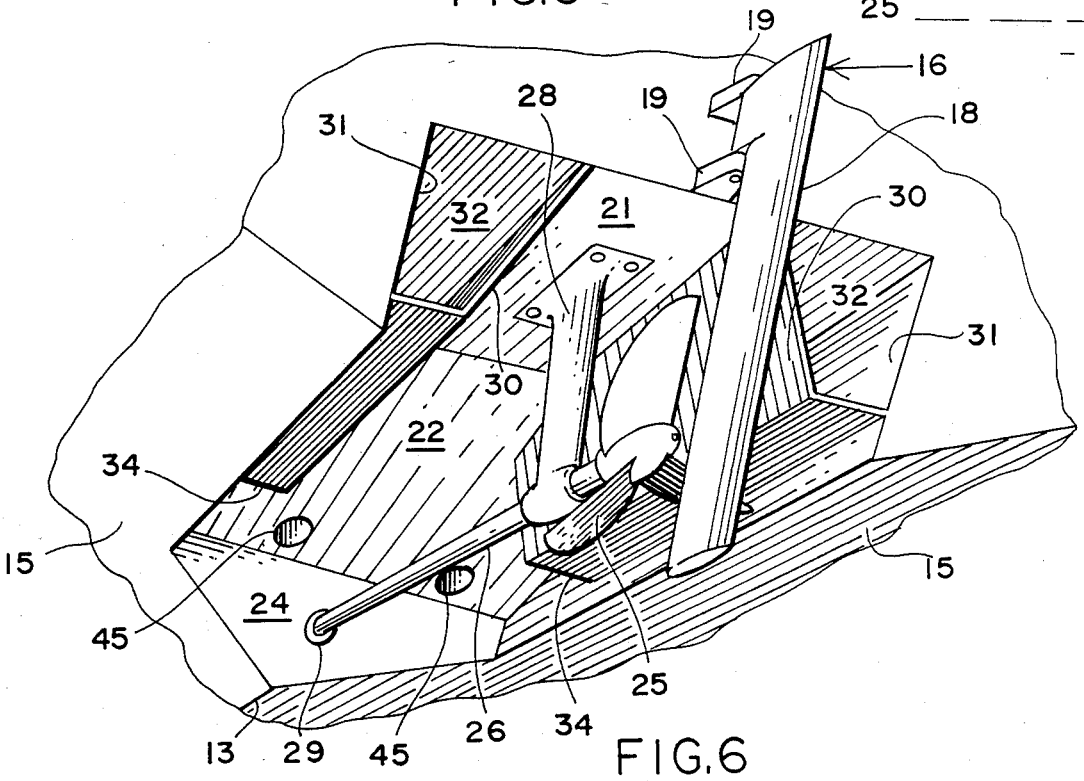
FIG. 6 is a perspective view taken from underneath and behind the surfacing propeller showing the interior portions of the tunnel.

A tunnel 20 is provided underneath the V-bottom 15. Turning now to FIGS. 5, 6 and 7, it will be seen that the tunnel has an upper surface which includes a transom plate portion 21, an engine plate portion 22 which slopes downwardly from the transom plate portion 21 which is essentially parallel to the path of travel, and terminating in a bottom plate 24 which intersects the V-bottom 15 of the boat in a relatively sharp line, particularly as seen in FIG. 6.

A surfacing propeller 25 is mounted interiorly of the tunnel and is driven by a drive shaft 26. The drive shaft 26 is mounted by a shaft mount to the transom plate portion 21 of the tunnel 20. A stuffing box 29 in the engine plate portion 22 of the tunnel 20 provides access to the drive assembly interiorly of the boat hull.

In accordance with the invention baffles 30 are provided at either side and the top of the tunnel 20, and intersect the tunnel sides 31 of the tunnel. The interior portion of the baffles includes a baffle channel 32. The front portion of the baffle channel 34 is located aft of the bottom plate 24 of the tunnel 20. As noted particularly in FIG. 6, the baffles 30 are trapezoidal in configuration with the rear portion opening through the transom 11. The forward portion of the baffle 34 opens at a position slightly above the plane of the drive shaft 26 and scoops water at slow speeds, but is proportioned to always be above the water at higher speeds.

Figure 4:
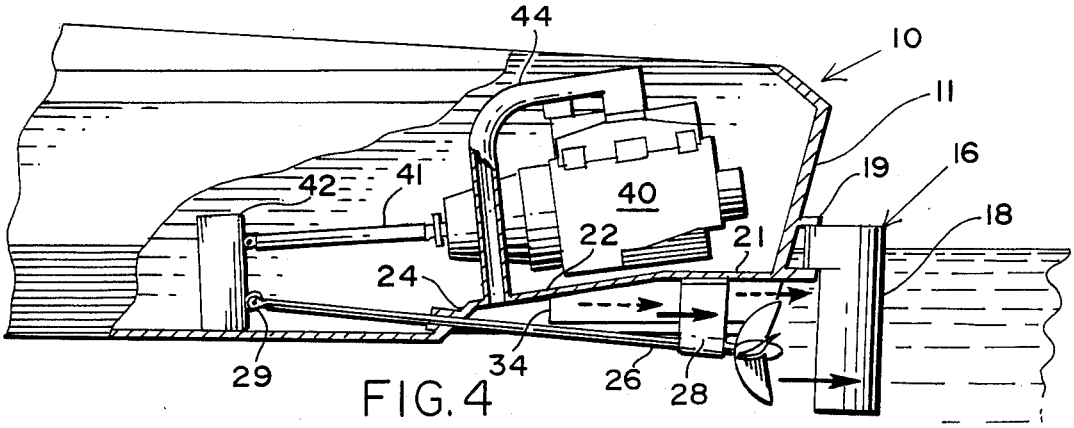
FIG. 4 is a longitudinal section view, in part, showing the interior of the propeller tunnel and the engine mount in the slow speed configuration.

As noted interiorly of the boat in FIGS. 4 and 5 an engine 40 is mounted above the engine plate 22 of the top of the tunnel 20. An engine drive shaft 41 extends forwardly to a gear box 42. Optionally, as shown in FIG. 4, the engine exhaust 44 is routed to the forward portion of the engine plate 22 of the tunnel 20, as shown in FIG. 6, exhaust ports 45 are located just aft of the bottom plate 24 of the tunnel. Also shown in phantom lines is the outline for a drive package and tunnel insert for conversion of existing boats.

CENTER OF GRAVITY

When establishing the center of gravity for this type of craft there are several important considerations. The surfacing type propeller has significant lift and effects the dynamic center of gravity. The absence of the bottom in the area of the tunnel as well as the level of the water and the air pressure in the tunnel have an effect on the dynamic center of gravity. The aerodynamic, hydrodynamic and drag forces are similar to other planing hulls. When the differences are considered this type of system requires a nominal center of gravity of only 20 to 30 pecent of hull length forward of the transom. This changes with hull design, speed of craft and horsepower.

PLATE LENGTHS

The length of the plates mentioned are proportioned to the size of craft and vary with the following considerations:

Bottom Plate 24: The bottom plate intersects the bottom at an angle greater than 30 degrees to promote separation of the flow stream at slow speeds. The length of the plate is appropriate to accommodate the shaft log with a minimum recommended vertical height of 25 percent of the propeller diameter.

Engine Plate 22: The engine plate length and angle are tailored to the engine configurations. The angle may be less than the bottom plate to parallel to the bottom of the hull terminating at the transom plate.

Transom Plate 21: The transom plate angle is to be parallel to the hull bottom at an elevation that allows 60 percent of the propellor diameter vertically from the keel line to the bottom of the plate. The length of the transom plate is determined by the rudder, strut, and propeller location. It is terminated at the forward end at the engine plate. The transom plate may terminate at its intersection with the bottom plate if the engine configurations allow. The rudder may be installed in the conventional manner under the hull if room permits or aft of craft.

Overall Tunnel 20 Length: The nominal tunnel 20 length for this type of system is 300 percent of the propeller diameter. Shorter configurations will inhibit acceleration and reduce tracking stability gained from the tunnel walls. Longer configurations will increase propeller submersion reducing top speed.

Propeller Location: The propeller is located to meet several of the following conditions:

1. The spray from the propeller must not cover the baffle inlets.

2. The minimum distance from the leading edge of the tunnel to the rear face of the propeller circle is to be 300 percent of the propeller diameter.

3. The nominal elevation of the propeller center line is to be coincident with the keel line. Up from this position increases top speed and craft crab angle. Down from this position has opposite effect.

4. Under dynamic conditions the propeller lift is included in the dynamic center of gravity and allows tuning of the craft for a window of speed. For speeds other than this window the attitude of craft can be adjusted by conventional trimming techniques.

Tunnel and Vent Areas: The area of the tunnel 20 and the vents (baffle channels 32) are to be constructed with the following considerations:

1. The venting area required is a minimum of 25 percent of the propeller circle area when the vents are in communication with ambient air. This venting area can be divided between the baffles and the vent tubes or contained entirely by one venting system.

2. The total area of the tunnel including the rear vents in the plane of the transom of the boat is to be 80 percent of the propeller circle area.

THE METHOD

The method of the present invention is directed to the flow of air interiorly of a surfacing propeller tunnel in a water craft. The method is performed by directing a flow of ambient air from the transom forward to the front portion of the surfacing propeller tunnel. Thereafter the air is permitted to reverse rearwardly and be engaged and accelerated by the non-submerged portion of the surfacing propeller which is in the air. Optionally the negative pressure tendency of the propeller tunnel is offset by confining the engine exhaust and directing the same interiorly of the tunnel.

Although particular embodiments of the invention have been shown and described in full here, there is no intention to thereby limit the invention to the details of such embodiments. On the contrary, the invention is to cover all modifications, alternatives, embodiments, usages and equivalents of the subject invention as fall within the spirit and scope of the invention, specification, and the appended claims.

What is claimed is:

1. A propeller tunnel and baffle for a marine craft having a surfacing propeller within the propeller tunnel, which tunnel terminates at the aft hull portion of the marine craft hull comprising, in combination essentially parallel sidewalls oriented vertically forming the tunnel for positioning beneath and at the aft hull portion of the marine craft and partially surrounding a surfacing propeller, said tunnel having an upper portion which inclines downwardly terminating in a forward portion with a bottom portion of the marine craft hull and terminating in the aft portion at the opposite end of the tunnel, baffles extending forwardly within said tunnel from aft of the propeller for permitting air to pass through from the aft hull portion to the forward portion of the tunnel and shielding the air within the baffles from pneumatic/hydraulic communication with the surfacing propeller.

2. In the propeller tunnel of claim 1, means for exhausting the engine exhaust forward of the propeller.

3. In the propeller tunnel of claim 1, a drive shaft seal in the forward portion of the tunnel, a drive shaft extending through the drive shaft seal and extending rearwardly, the surfacing propeller positioned in the rearward end of the propeller shaft forward of the aft hull portion.

4. In the propeller tunnel of claim 1, said marine craft hull having a V-bottom forming a keel line, said forward portion of the tunnel upper portion having an angle in excess of 30° with that of the keel line at the point where the forward portion joins the hull.

5. In the propeller of claim 1, said tunnel length being approximately 400% of the propeller diameter.

6. In the propeller tunnel of claim 1, said baffles having a cross-sectional area, said cross-sectional area being provided to a minimum of 20% of the projected area of the propeller.

7. In the propeller tunnel of claim 1, said tunnel having a total cross-sectional area, said propeller having a total projected area, said tunnel area in cross-section being approximately a minimum of 80% of the projected area of the propeller.

8. The method of venting a surfacing propeller located towards the transom of a boat hull comprising the steps of:

providing a surfacing propeller tunnel having an upper portion and partially surrounding the propeller and extending forward of the propeller and terminating by sloping to intersect with the bottom of the hull, providing a confined stream of air within the tunnel and shielded from pneumatic and hydraulic communication with the surfacing propeller in open communication with ambient air aft of the propeller and terminating forward of the propeller, and reversing the flow of air forward of the propeller and exhausting the air stream through the surfacing portion of the propeller area.

9. In the method of claim 8, assisting in the venting of the tunnel by directing the engine exhaust into the tunnel forward of the propeller.

10. In the method of claim 8, controlling the confined stream of air to ambient through a baffle having a cross-sectional area greater than 20% of the total projected area of the propeller.

11. In the method of claim 8, the confined stream of air being provided by positioning a baffle in the propeller tunnel.

12. In the method of claim 11, proportioning the confined stream of air provided by the baffle to have a cross-sectional area in excess of 20% of the projected area of the propeller.

13. In the method of claim 8, locating the confined stream of air in a baffle attached to the tunnel and terminating forward of the propeller.

14. In the method of claim 13, proportioning the baffle cross-sectional area to be in excess of 20% of the propeller area.

15. In the method of claim 14, proportioning said propeller tunnel to be approximately 400% of the propeller diameter in length.

16. The method of venting a surfacing propeller positioned towards the transom of a boat hull having a keel line and comprising the steps of:

providing a surfacing propeller tunnel having an upper portion and extending forward from the transom while partially surrounding the surfacing propeller and extending forward of the propeller and terminating by sloping downward and forward to intersect with the bottom of the hull, providing an angle in excess of 30% with that of the keel line of the hull measured vertically at the intersection of the keel line and forward portion of the tunnel, venting said propeller by confining air within the tunnel and above its lower portion in an open communication with ambient air aft of the propeller and terminating in the propeller tunnel forward of the propeller, proportioning said venting cross-sectional area to be a minimum of 20% of the propeller area, proportioning said propeller tunnel to be approximately 400% of the propeller diameter in length.

17. A propeller tunnel and baffle for a marine craft having a surfacing propeller, a transom, and a hull comprising, in combination, essentially parallel sidewalls oriented vertically forming a tunnel for positioning beneath and at the rear of a marine craft and surrounding a surfacing propeller, said tunnel having an upper portion with inclined segments terminating in a forward portion with a V-bottom portion of the marine craft and terminating in a rearward transom portion at the opposite end of the tunnel, baffles provided within the tunnel and above the lower portion of the tunnel extending forwardly from the rear of the marine craft and aft of the propeller and including the sides of the tunnel for permitting air to pass through from the rear of the marine craft to the forward portion of the tunnel, said baffles terminating aft of the forward portion of the tunnel.

18. In the propeller pocket of claim 17, means for exhausting engine exhaust forward of the forward end of the baffles.

19. In the propeller tunnel of claim 18, the center of gravity of the subject marine craft being located 20% to 30% forward of the rear end portion.

20. In the propeller tunnel of claim 18, said bottom plate having an angle in excess of 30° with that of the hull at the point where the bottom plate joins the hull.

21. In the propeller tunnel of claim 18, said hull having an engine mount and gear box, said engine plate being essentially angled per the optimum engine mount and gear box angle.

22. In the propeller tunnel of claim 17, the upper portion of said tunnel having three portions, a first portion being a transom plate essentially parallel with the water line of the boat, a second portion being an engine plate portion sloping downwardly toward the bottom, and a third bottom portion descending at a steeper angle than the engine plate portion and joining the hull, a stuffing box in said third bottom portion, a drive shaft having a surfacing propeller extending through said stuffing box, said propeller being in a plane forward of the transom.

23. In the propeller tunnel of claim 17, said transom plate being 60% of the propeller diameter from the keel line to the plate bottom.

24. In the propeller tunnel of claim 17, said tunnel length being approximately 400% of the propeller diameter.

25. In the propeller tunnel of claim 17, said cross-sectional area being approximately 25% of the projected area of the propeller.

26. In the propeller tunnel of claim 17, said tunnel having a total cross-sectional area, said propeller having a total projected area, said tunnel area in cross-section being approximately 80% of the projected area of the propeller.

27. The method of venting a surfacing propeller positioned towards the aft portion of a boat hull having a keel line and comprising the steps of:

providing a surfacing propeller tunnel having an upper portion and extending forward from the aft portion of the boat hull while partially surrounding the surfacing propeller and extending forward of the propeller and terminating by sloping downward and forward to intersect with the bottom of the hull, providing a confined stream of air shielded from pneumatic and hydraulic communication with the surfacing propeller above the lower portion of said surfacing propeller tunnel and in open communication with the aft portion of the boat and which terminates forward of the propeller, and reversing the flow of air of said confined stream assisted by the movement of the boat forwardly and the pneumatic drive of the surfacing propeller when said propeller has its upper portion out of the water.

* * * * *

UNITED STATES PATENT AND TRADEMARK OFFICE

CERTIFICATE OF CORRECTION

PATENT NO. : 4,689,026

DATED : August 25, 1987

INVENTOR(S) : Mark S. Small

It is certified that error appears in the above-identified patent and that said Letters Patent is hereby corrected as shown below:

Column 6, line 19, claim 16, "an angle in excess of 30%" should read -- an angle in excess of 30° --.

The figure "400% appearing in claims 5, 15 and 16 is incorrect and inconsistent with the disclosure in the body of the patent itself and is, therefore, changed in all three locations to read --300% --.

Column 7, line 19, claim 24, "400%" should read --300% --.

Signed and Sealed this

Thirtieth Day of January, 1990

*Attest:*

JEFFREY M. SAMUELS

*Attesting Officer* *Acting Commissioner of Patents and Trademarks*